United States Patent [19]

Ruer et al.

[11] 4,205,715

[45] Jun. 3, 1980

[54] METHOD OF CONTINUOUS CENTRIFUGALLY CASTING OF METAL STRANDS OF NON-CIRCULAR CROSS-SECTION

[75] Inventors: Jacques Ruer; Jean-Pierre Birat, both of Metz, France

[73] Assignee: Institut de Recherches de la Siderurgie Francaise, Saint-Germain-en-Laye, France

[21] Appl. No.: 905,868

[22] Filed: May 15, 1978

[30] Foreign Application Priority Data

May 18, 1977 [FR] France ..... 77 15830

[51] Int. Cl.[2] ..... B22D 11/10; B22D 27/02

[52] U.S. Cl. ..... 164/49; 164/84

[58] Field of Search ..... 164/82, 84, 48, 49, 164/146, 147, 418, 422, 437, 438, 83, 85–89

[56] References Cited

U.S. PATENT DOCUMENTS

| | | | |
|---|---|---|---|
| 2,548,696 | 4/1951 | Barstow et al. | 164/89 |
| 3,702,630 | 11/1972 | Peytavin et al. | 164/82 |
| 3,776,295 | 12/1973 | Mola et al. | 164/84 |
| 3,952,791 | 4/1976 | Ito et al. . | |
| 4,026,346 | 5/1977 | Birat et al. | 164/147 |

FOREIGN PATENT DOCUMENTS

| | | | |
|---|---|---|---|
| 851871 | of 1939 | France | 164/85 |
| 410650 | of 1945 | Italy | 164/89 |
| 146495 | of 1954 | Sweden | 164/84 |
| 337192 | 5/1972 | U.S.S.R. | 164/89 |
| 383521 | 8/1973 | U.S.S.R. | 164/437 |
| 440203 | 1/1975 | U.S.S.R. | 164/147 |

*Primary Examiner*—Robert D. Baldwin
*Assistant Examiner*—K. Y. Lin
*Attorney, Agent, or Firm*—Michael J. Striker

[57] ABSTRACT

A method of continuous centrifugally casting of metal strands of non-circular, preferably substantially square cross-section, in which the metal continuously passing through an ingot mold of corresponding cross-section is rotated about the longitudinal axis of the mold by means of a rotating magnetic field which may be created by a stationary multi-phase inductor, and wherein the metal in the mold is continuously replenished by a jet of liquid metal impinging on the free surface of the metal in the mold at a point of impact in the neighborhood of one corner of the mold, preferably at a point located on the diagonal substantially midway between the mold wall and the center of the mold. This method causes any slack contained in the metal to concentrate at the center of the free upper metal surface in the mold, from where it can be easily removed.

5 Claims, 2 Drawing Figures

A A
B B

METHOD OF CONTINUOUS CENTRIFUGALLY CASTING OF METAL STRANDS OF NON-CIRCULAR CROSS-SECTION

BACKGROUND OF THE INVENTION

The present invention relates to a method of continuous centrifugally casting of metals, especially steel. The present invention is especially directed to the casting of metal strands having a square, rectangular or generally non-circular cross-section in which the metal continuously passing through an ingot mold of corresponding cross-section is rotated by means of a rotating magnetic field.

It is well known that continuous casting of metal in which the liquid metal in the ingot mold is rotated about the axis of the latter presents various advantages as compared with the method of continuous casting in which the metal in the mold is not rotated, in that the quality of the produced casting is in the first-mentioned method considerably improved as far as the structure of the obtained solidified metal and the absence of inclusion of foreign matter in the same is concerned.

It is further well known that the metal may be rotated during the casting process by mechanical means by rotating the ingot mold and providing rotating means which extract the solidified metal from the mold, or, the liquid metal in the mold may be rotated electromagnetically by means of a rotating magnetic field created by a stationary polyphase inductor surrounding the cast product preferably at the level of the ingot mold.

At the present state of the development the two above-mentioned methods of rotating the liquid metal in the mold furnish products of substantially identical quality. Nevertheless, the method of rotating the liquid metal in the ingot mold by mechanical means has, as compared with the method of rotating the liquid metal in the mold by electromagnetic means, a number of major disadvantages, especially since the method of rotating the liquid metal by mechanical means cannot be employed in every type of continuous casting and for every type of cast products, since it necessarily requires rotation of the cast product about a vertical axis. Thus it is not possible to utilize a method in which the liquid metal in the mold is rotated by mechanical means during continuous casting of metal strands with a curved axis, nor during continuous casting of metal strand of non-circular cross-section. The centrifugal casting of metal strands in which the liquid metal is rotated by electromagnet means, on the other hand, may be more generally used as far as the type of apparatus for continuous casting and the form of the cast product is concerned. Installation for continuous casting of metal strands in which the liquid metal is continuously rotated during its passage through the ingot mold by electromagnet means are known in the art and for instance disclosed in the French Patent Nos. 2,279,500; 2,315,344 and the corresponding U.S. Pat. No. 4,026,346 and the U.S. patent application Ser. No. 748,301, as well as in the German Patent No. 1,159,516, which are herewith incorporated as references for showing such installations in detail.

SUMMARY OF THE INVENTION

It is an object of the present invention to improve the method of continuous centrifugally casting of metal strands in which the liquid metal in the ingot mold is rotated by electromagnet means and in which the metal strand produced has a square, a rectangular or a general non-circular cross-section.

With these and other objects in view, which will become apparent as the description proceeds, the method according to the present invention of continuous centrifugally casting a metal strand of non-circular, preferably square or rectangular cross-section mainly comprises the steps of rotating liquid metal continuously passing through an ingot mold of corresponding cross-section by means of a magnetic field turning about the longitudinal axis of the mold, and continuously replenishing liquid metal in the mold by jet of such metal impinging on the free surface of the metal in the mold at a point of impact located in the neighborhood of one corner of the ingot mold.

In a preferred form of carrying out the method of the present invention the point of impact of the jet of liquid level is localized on a diagonal of a transverse cross-section through the casting, substantially midway between the wall of the ingot mold and the center of the product, and if the transverse cross-section of the cast metal strand is square, the point of impact of the jet of liquid metal is preferably localized substantially at a point spaced a quarter of the length of the diagonal from a corner of the square.

The rotating magnetic field is preferably produced by a stationary polyphase inductor which surrounds the ingot mold to thereby create a rotating magnetic field turning about the axis of the ingot mold.

The results obtained by the method of the present invention reside in the gathering of dross or slag at the center of the free upper metal surface in the ingot mold, that is at the lowest point of the meniscus, which permits, on the one hand, to avoid formation of a slag skin on the cast product, and, on the other hand, to "fish out" easily such slag or dross gathering at the lowest point of the meniscus during the continuous casting of the metal strand. Such "fishing out" of slag or other impurities collecting at the center of the meniscus is usually manually performed by extending the end of a cold metal rod into the collected mass of slag, which hardens on the cool surface on the rod and can thus be easily withdrawn.

The present invention is the result of experiments carried out by the inventors, which have shown that under the action of a rotating magnetic field the movement of the liquid metal at the level of the meniscus will result in a characteristic image and that the concentration of the dross or slag at the center of the meniscus can be obtained only if the jet of metal for replenishing the metal continuously passing through the ingot mold impinges on the free metal surface at a specific location as disclosed in the present application.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
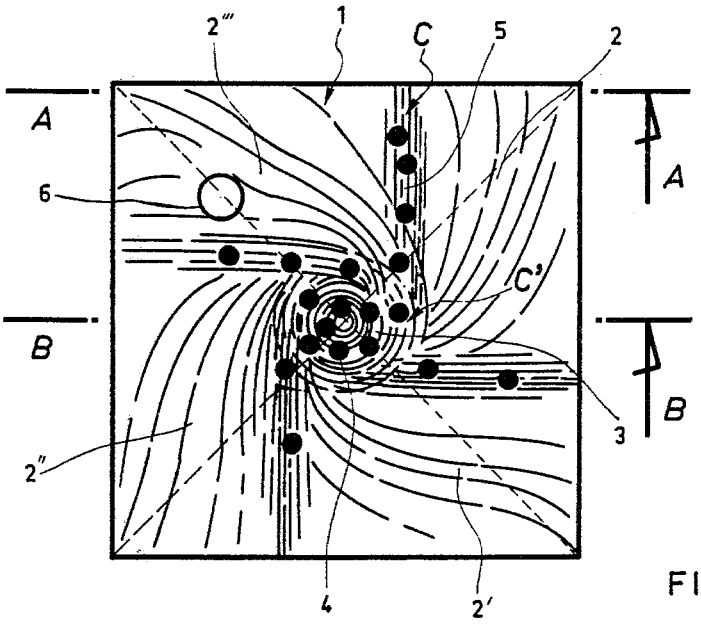
FIG. 1 is a schematic top view of the meniscus forming at the upper free surface of the liquid metal in the ingot mold.
Figure 2:
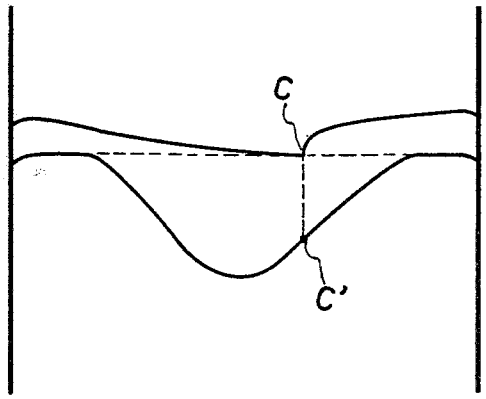
FIG. 2 schematically indicates two superimposed cross-sections taken along the line A—A, respectively along the line B—B of FIG. 1.

The FIGURES of the drawing relate to the casting of a metal strand or billet of square transverse cross-section, but the traces of the movement of the liquid metal indicated at the level of the meniscus hold also true if the cast product is of rectangular cross-section provided the longer side of the rectangle has a length not greater than about 1.5 times of the length of the shorter side. As can be clearly seen from FIG. 1, the meniscus 1 of the liquid metal forming under the action of the rotating magnetic field is separated into four identical nappes or sheets 2, 2', 2'' and 2''' which are arranged about the central vortex 3, which constitutes the low point of the meniscus. As can also be visualized from the drawing the liquid metal rises at the corners of the ingot mold to flow from there toward the central vortex. In this way the free surface of the liquid metal in the ingot mold is cleansed due to the movement of the dross or slag toward the vortex. The dross or slag is schematically illustrated in FIG. 1 by the black spots 4. The separation between two successive nappes or sheets occurs by narrow zones 5 which are substantially straight and normal to the wall of the ingot mold and substantially tangent to the whirl of the central vortex. The profile of each zone 5 of separation, as shown in FIG. 2 (line CC') is shaped like a valley starting at a high point at the wall of the ingot form (point C) and descending from there into the cup (point C') constituted by the central vortex. The inventor has ascertained that this valley and the three corresponding ones, distribute themselves regularly about the axis of the ingot mold and constitute a flow path for the dross or slag from the periphery of the ingot mold to the central vortex. It appears therefore that in order to obtain the desired result, that is the assembly of the dross at the center of the meniscus, requires that the aforementioned valleys will not be destroyed nor disturbed by the jet of liquid metal by means of which the metal in the ingot mold is continuously replenished. The experiments carried out by the inventor have shown that these conditions may be obtained in a satisfactory manner if the point of impact of the jet of liquid metal onto the upper surface of the liquid metal in the ingot mold is localized in the neighborhood of the center of a sheet, that is adjacent to a corner of the ingot mold. The best results are obtained if the point of impact of the jet is localized on a diagonal through the meniscus substantially midway between one corner of the ingot mold and the center of the latter. This preferred position of the point of impact is represented in FIG. 1 by the small circle 6. It is mentioned that the orientation of the jet of liquid metal does not essentially influence the result obtained from the method according to the present invention and the jet may be substantially parallel to the longitudinal axis of the ingot mold or slightly oblique thereto, preferably in the direction of rotation of the metal.

The image of the traces of movement represented in the FIGURES of the drawing is obtained at a speed of rotation of the metal or steel in the neighborhood of 120 revolutions per minute. Under these conditions the nappes and the separation zones 5 remain stable, that is they do not turn, and the experiments carried out by the inventor have shown that such stability will be maintained at a range of speed between 100 to 150 revolutions per minute. This speed of revolution corresponds to the speed generally practiced during continuous centrifugal casting of metal products of circular cross-section. Below this range, that is at speeds of rotation of about 70 to 100 revolutions per minute, the meniscus is transformed into a central surface which turns in a regular manner with the corners remaining immobile. The limit of the turning surface is practically a perfect circle, but the meniscus is not cleaned and the dross localized at the corner does not assemble at the center. At a number of revolutions below 70 revolutions per minute the surface of the meniscus appears like solidified and the meniscus curves slightly toward the center without causing the dross to assemble at the center. At a number of revolutions above 150 revolutions per minute, the liquid metal rises violently at the corners of the ingot mold and the nappes become unstable. If the speed of revolution passes 170 revolutions per minute, rising eddy currents are also formed midway between the corners of the ingot mold and the nappes as well as the narrow regions of separations disappear in the general turbulence of the metal. The central vortex becomes rather deep, in the order of 4 to 5 centimeters, and the casting process is accompanied by a pronounced noise.

From the above it will be understood that the method according to the present invention should be used with the magnetic field rotating at 100 to 150 revolutions per minute since outside this range the nappes and the valleys separating the same, which produce concentration of the impurities, such as dross or slag, at the center of the vortex are practically non-existent.

The values indicated above have been determined by experiments carried out with a product of transverse square cross-section in which the sides of the square had a length of 12 centimeters. These values remain however valid for all products of quadrangular cross-section provided, as mentioned before, that the lengths of the sides of the quadrangle do not deviate essentially from each other.

It will be understood that each of the elements described above, or two or more together, may also find a useful application in other types of methods of continuous centrifugal casting of metals, especially steel, differing from the types described above.

While the invention has been illustrated and described as embodied in a method of continuous centrifugal casting of metal, especially steel, in which the cross-section of the finished product is non-circular, preferably square, and in which the liquid metal in the ingot mold is rotated by an electromagnet field rotating at 100 to 150 revolutions per minute, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of continuous casting a metal strand of quadrangular transverse cross-section comprising the steps of rotating liquid metal continuously passing through an ingot mold of corresponding cross-section and having a longitudinal axis by means of a magnetic field turning about said longitudinal axis; and continuously replenishing liquid metal in the mold by a jet of such metal impinging on the free surface of the metal in the mold in the neighborhood of one corner of the latter, said neighberhood extending to a distance substantially midway between said corner to the center of the mold.

2. A method as defined in claim 1, wherein the point of impact of the jet of liquid metal is located on a diagonal of the free surface of the liquid metal in the ingot mold substantially midway between one corner of the mold and the center of the surface.

3. A method as defined in claim 1, wherein the cross-section of the metal strand to be cast is square, and wherein the point of impact of the jet of liquid metal is located on the diagonal of the square cross-section spaced from one corner of the cross-section a distance equal to a quarter of the length of the diagonal.

4. A method as defined in claim 1, wherein the speed of rotation of the liquid metal at the level of the free surface of the liquid metal in the ingot mold is between 100 and 150 revolutions per minute.

5. A method as defined in claim 1, wherein said quadrangular transverse cross-section has a longer side which has a length at most 1.5 times the length of the shorter side thereof.

* * * * *